US006601412B1

(12) United States Patent
Quay et al.

(10) Patent No.: US 6,601,412 B1
(45) Date of Patent: Aug. 5, 2003

(54) TAKEDOWN UNIT FOR CIRCULAR KNITTING MACHINE

(75) Inventors: Earl Robert Quay, Orangeburg, SC (US); Donald Charles Fosselman, Easley, SC (US); Aiken Anderson Still, IV, North, SC (US)

(73) Assignee: Mayer Industries, Inc., Orangeburg, SC (US)

( * ) Notice: Subject to any disclaimer, the term of this patent is extended or adjusted under 35 U.S.C. 154(b) by 0 days.

(21) Appl. No.: 10/225,226

(22) Filed: Aug. 21, 2002

(51) Int. Cl.[7] ..... D04B 15/88
(52) U.S. Cl. ..... 66/152; 66/149 R
(58) Field of Search ..... 66/147, 149 R, 66/150, 151, 152, 153; 242/523, 535, 535.3, 539, 547, 548

(56) References Cited

U.S. PATENT DOCUMENTS

| | | | |
|---|---|---|---|
| 799,081 | A | 9/1905 | Obenhoff et al. |
| 2,521,258 | A | 9/1950 | Semotan |
| 2,641,117 | A | 6/1953 | Desmonds |
| 3,003,342 | A | 10/1961 | Kent et al. |
| 3,430,464 | A | 3/1969 | Mazzi |
| 3,500,664 | A | 3/1970 | Peberdy |
| 3,930,603 | A | 1/1976 | Grant |
| 3,981,129 | A | 9/1976 | Briaire |
| 4,314,462 | A | 2/1982 | Ducol et al. |
| 4,503,689 | A | 3/1985 | Goller et al. |
| 4,576,019 | A | 3/1986 | Keel et al. |
| 4,879,886 | A | 11/1989 | Okada et al. |
| 4,969,340 | A | 11/1990 | Brega |
| 5,167,134 | A | 12/1992 | Fücik et al. |
| 6,016,670 | A | 1/2000 | Kuhrau et al. |
| 6,029,478 | A | 2/2000 | Panuccio |
| 6,041,482 | A | 3/2000 | Zhu et al. |

*Primary Examiner*—Danny Worrell
(74) *Attorney, Agent, or Firm*—Alston & Bird LLP

(57) ABSTRACT

A takedown unit includes a set of takedown rollers arranged around tubular fabric hanging downward from a needle cylinder of a circular knitting machine. The takedown rollers rotate to draw down the hanging tubular fabric, and a floating guide mechanism is within and encircled by the hanging tubular fabric, so that the low-friction guide mechanism interacts with the high-friction takedown rollers to facilitate the drawing down of the fabric. A set of cams extends at least partially around the hanging fabric, and the cams and the takedown rollers are mounted to allow relative rotation therebetween, with the relative rotation being around the hanging fabric. Actuators are positioned for interacting with the cams in response to the relative rotation, so that the cams actuate the actuators which in turn rotate the takedown rollers.

32 Claims, 11 Drawing Sheets

TAKEDOWN UNIT FOR CIRCULAR KNITTING MACHINE

BACKGROUND OF THE INVENTION

The present invention relates to a circular knitting machine and, more particularly, to a takedown unit for drawing down tubular fabric that hangs downwardly in the knitting machine.

A circular knitting machine includes a rotating knitting cylinder with a knitting assembly for forming the tubular knitted fabric. The knitted fabric is delivered from the needles in a hanging condition from the knitting cylinder and rotates with the cylinder. A takedown unit is positioned beneath the knitting cylinder to draw the knitted fabric from the cylinder.

One type of conventional takedown unit rotates synchronously with the knitting cylinder to avoid twisting the fabric as it rotates with the cylinder. This takedown unit includes a pair of elongate, driven pinch rollers. The knitted fabric is fed through the nip defined between the pinch rollers so that the takedown unit flattens the fabric. Problems occur, however, because different portions of the fabric may be exposed to different amounts of pressure and tension, which can cause an undesirable lack of uniformity and other defects in the fabric.

U.S. Pat. No. 6,029,478 to Panuccio discloses a rotating cam box knitting machine with a large number of tensioning rollers that are respectively arranged on stationary axes around the perimeter of the knitted fabric descending from the knitting cylinder. The tensioning rollers cooperate with contrast rollers located on the inside of the knitted fabric, and each tensioning roller is actuated by a separate motor. The tensioning rollers and corresponding freely-rotating contrast rollers avoid problems encountered with pinch rollers that flatten the fabric.

Even though a wide variety of improved takedown units have been developed, it is still common for takedown units to complicate the operation of, or be responsible for problems that occur during the operation of, circular knitting machines. For example, conventional takedown units can introduce defects and distortion in the knitted pile fabric, such as by pinching and thereby marking fabrics made with fragile polymer fibers and yas such as polypropylene or lycra. In addition, in some takedown units, pinched points, folds, and slippage mark defects can be caused by the use of pinch rollers and the pressure between the pinch rollers as the fabric passes through them. Although accurate control of the tension applied to the fabric is fundamental to maintaining high fabric quality, some conventional takedown units fail to provide accurate control. Other takedown units provide accurate control only by incorporating equipment that is unnecessarily cost prohibitive or complicated.

In view of the foregoing and for other reasons, there is a need for an improved takedown unit.

BRIEF SUMMARY OF THE INVENTION

On aspect of the present invention is an improved takedown unit and associated methods used in a circular knitting machine. The takedown unit of the present invention can be characterized as an item that is separate from any circular knitting machine (i.e., a subcombination), in which case the takedown unit may be retrofittable to an existing circular knitting machine. The takedown unit of the present invention can also be in combination with a knitting machine.

One aspect of the present invention is a takedown unit for a circular knitting machine that includes a rotating knitting cylinder for forming tubular fabric such that the tubular fabric hangs downward along a fabric travel path from the knitting needles, with the takedown unit including a set of driven takedown rollers mounted around the fabric travel path, and a floating guide mechanism within/encircled by the hanging tubular fabric and interacting with the takedown rollers. The guide mechanism spreads the hanging tubular fabric for facilitating engagement of the driven takedown rollers against the tubular fabric. Very generally described, the guide mechanism can be in the shape of an inverted top hat, a cone, a truncated cone or a funnel, or the like. The guide mechanism is preferably not rigidly connected to any structure of the circular knitting machine, or the like, so that the guide mechanism floats within the interior of the tubular fabric that is traveling downward from the knitting cylinder. This floating preferably equalizes the forces applied to the fabric by the takedown unit to promote optimal operation. The guide mechanism cooperates with the takedown rollers to define a set of nips through which the tubular fabric extend, and the nips are preferably positioned above the rotational axes of the takedown rollers.

In accordance with one aspect of the present invention, the takedown unit includes a set of cams that extends at least partially around the fabric travel path and cooperates with at least one actuator for driving at least one of the takedown rollers. The cams and takedown rollers are mounted to allow relative rotation therebetween, with this relative rotation being around the fabric travel path. The actuator is positioned for engaging the cams in response to the relative rotation between the takedown rollers and cams, so that the cams preferably actuate the actuator multiple times for each 360 degrees of relative rotation between the set of takedown rollers and the set of cams. Each actuation of the actuator includes a reciprocating motion of a component of the actuator, with the reciprocating motion preferably being upright, although the reciprocating may be radial or in other directions. The actuator is preferably operative for translating the reciprocating motion into unidirectional rotation of at least one of the takedown rollers, with this rotation being for drawing down the fabric.

In accordance with one aspect of the present invention, there is a separate actuator for each of the takedown rollers. In accordance with this aspect, each actuator includes a lever and an output shaft that is preferably configured for rotating substantially only in one direction in response to reciprocation of the lever. The output shaft of each actuator is connected to a respective takedown roller for causing it to rotate preferably substantially only in the one direction and thereby draw down the fabric. Preferably the cams and actuators are operative so that the actuators operate synchronously to rotate the takedown rollers synchronously.

In accordance with one aspect of the present invention, the throws of the cams are adjustable for the purpose of adjusting the action of the actuators and thereby the rotation of the takedown rollers. In accordance with this aspect, an adjustment ring preferably extends around the series of cams, with the adjustment ring and the series of cams being mounted to allow relative rotation therebetween, with this relative rotation preferably synchronously and uniformly adjusting the throws of all of the cams. The throws of the cams can advantageously be adjusted while the knitting machine is operating, to change the takedown rate in coordination with knitting changes.

In accordance with one aspect, the takedown unit of the present invention may reduce the amount of tension imparted on the fabric for takedown, thus allowing the fabric to be drawn down from the knitting cylinder with a minimum force and pressure on the fabric, so that the knitting assembly can knit "naturally." Also, preferably the tension in the fabric that results from the operation of the takedown unit is not excessive, and is substantially similar in all portions of the knitted fabric being formed, to advantageously provide a uniform knitted fabric. This advantageously seeks to avoid or minimize the introduction of defects and distortion in the knitted fabric, such as pinching or marking of fabrics made with fragile polymer fibers such as polypropylene or yarns with spandex lycra. The present invention also seeks to avoid the introduction of "tiger stripe" defects in pile fabric, which can be caused by indiscriminate slippage and can result in an undesired appearance after a finish is applied to the fabric. The present invention preferably advantageously keeps the fabric tube from contacting the inside of the needle cylinder, which can be caused by the flattening and thus widening of the fabric tube in conventional takedown units with only two pinch rolls. The present invention also seeks to avoid the introduction of pinched points, slippage marks and fold defects caused by the use of pinch takedown rollers and the pressure between the pinch takedown rollers as the fabric passes through them. The advantages of the present invention also include the possibility of using less power than a traditional takedown unit. It is also expected that the takedown unit of the present invention may be less expensive than prior pinched-type takedown units by eliminating the magnetic takedown clutch and the big ring gear that drives the traditional pinch rolls.

Other aspects and advantages of the present invention will become apparent from the following.

BRIEF DESCRIPTION OF THE SEVERAL VIEWS OF THE DRAWINGS

Figure 1:
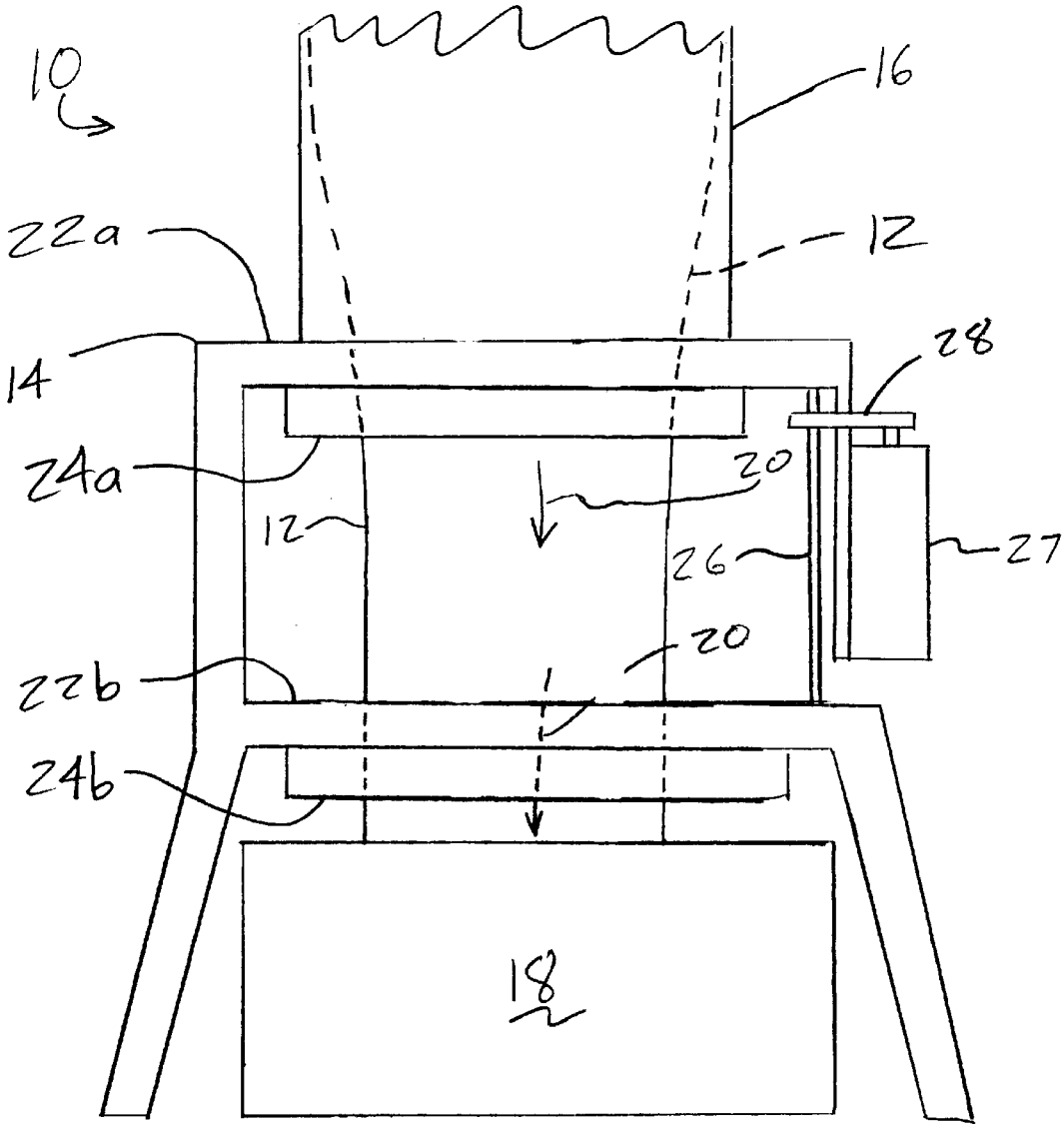
Figure 2:
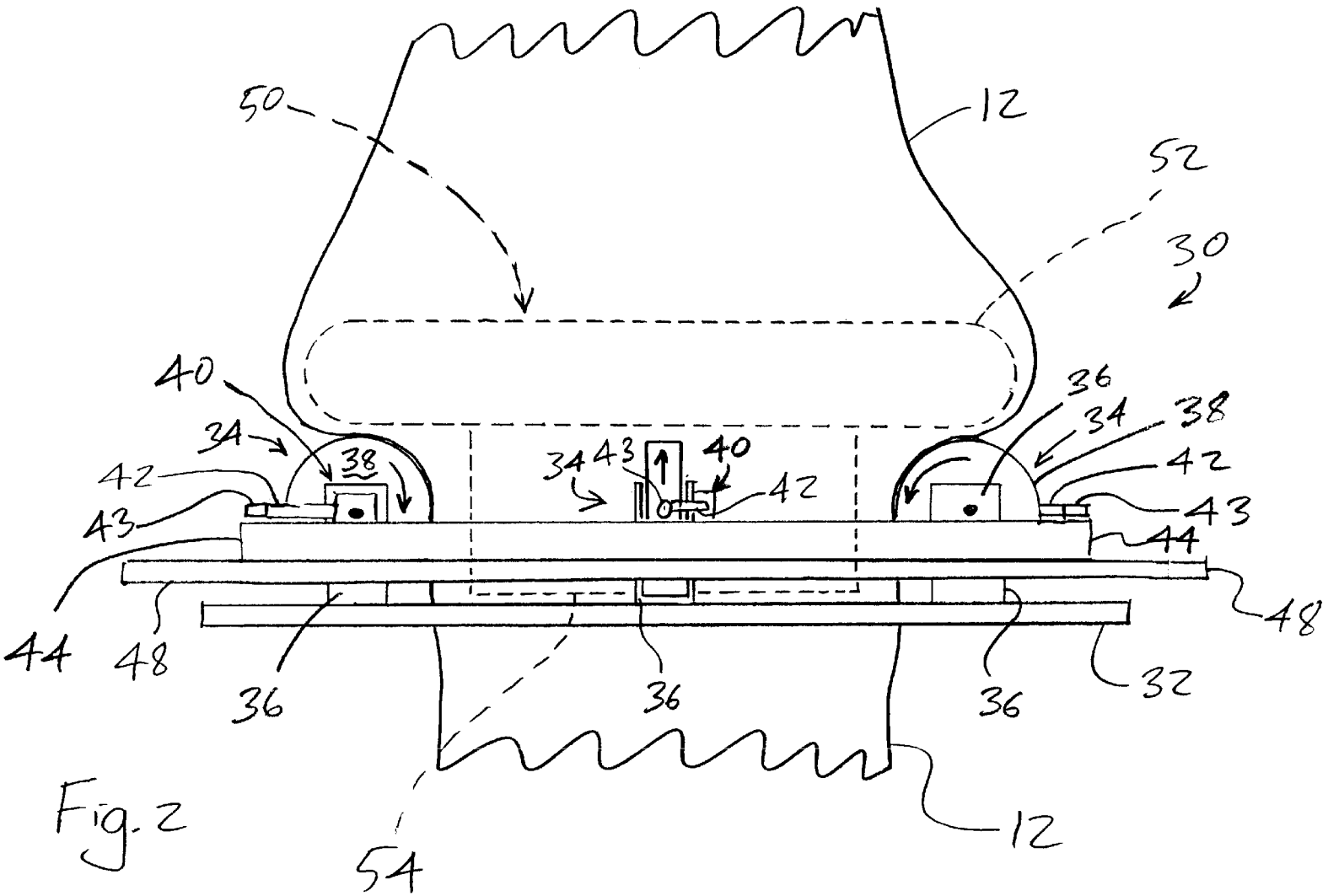
Figure 3:
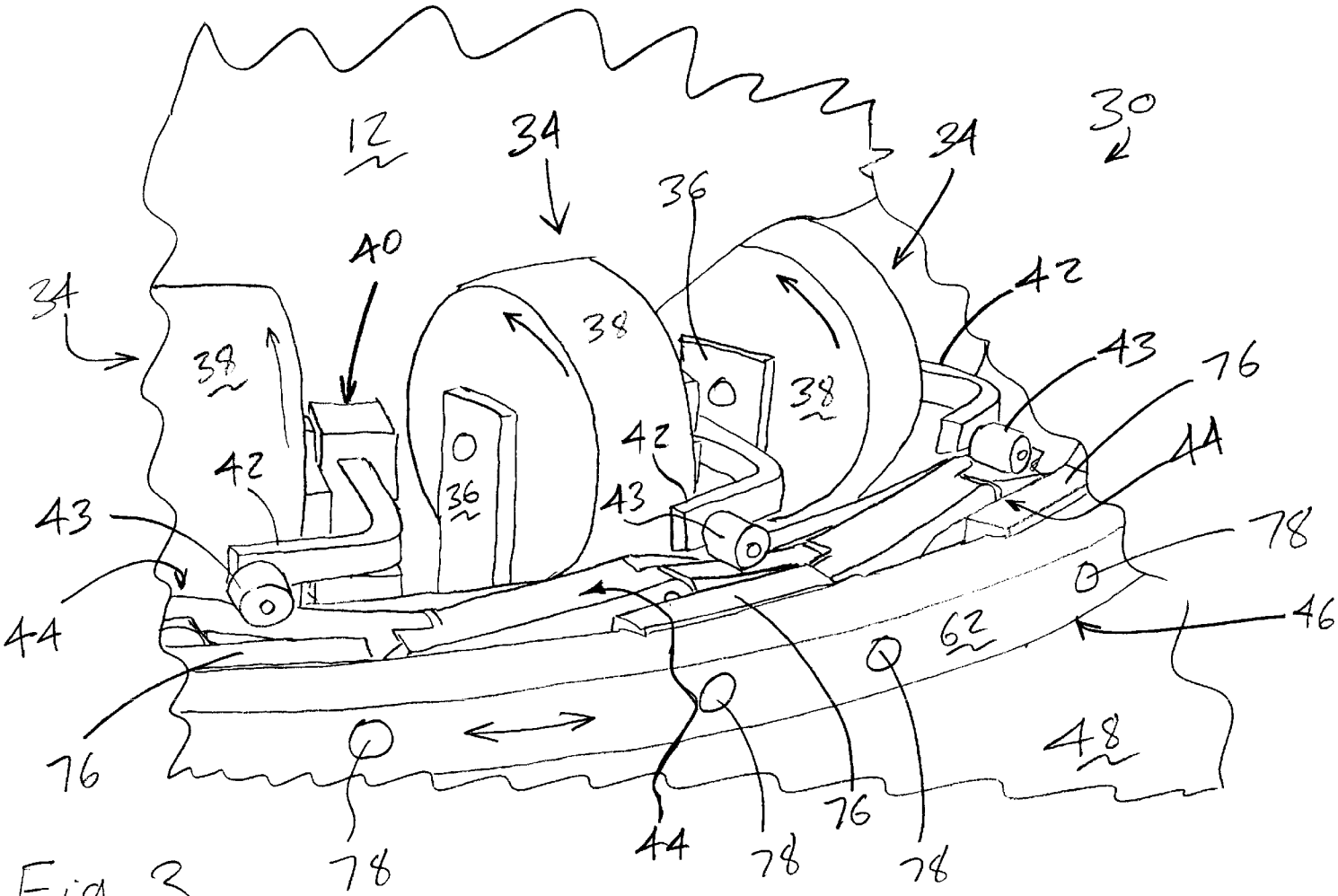
Figure 4:
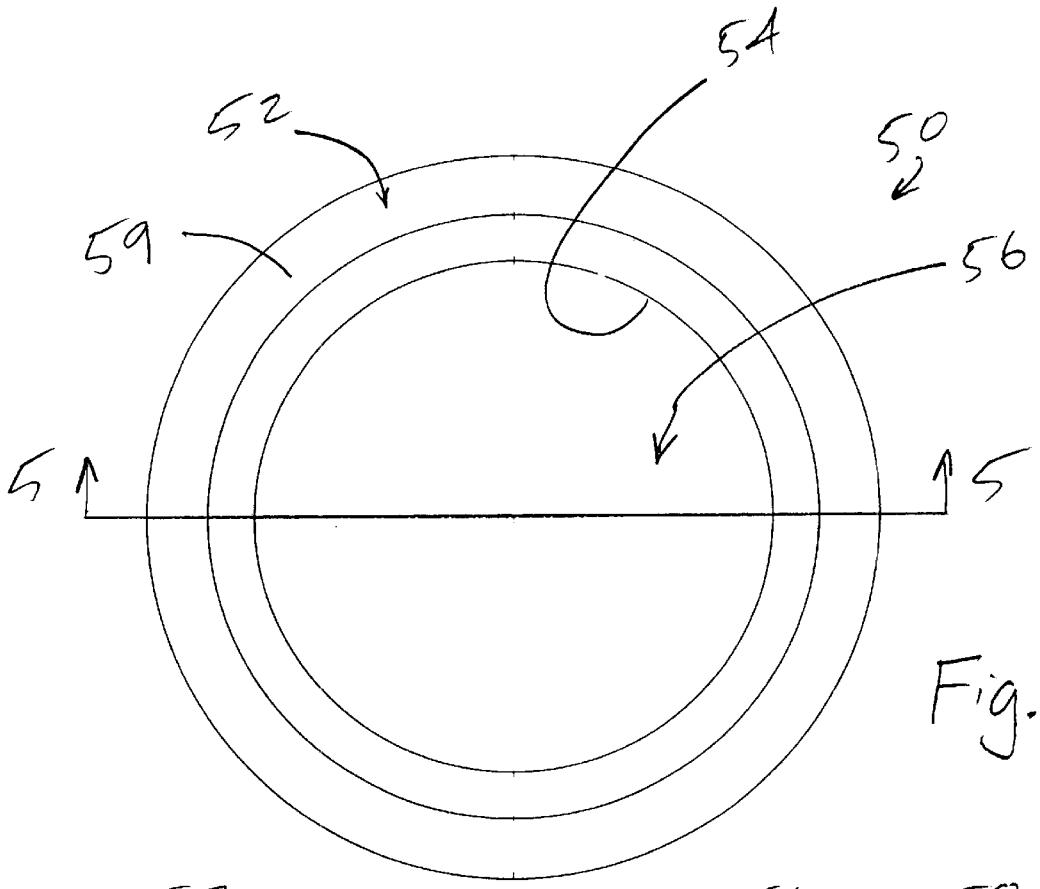
Figure 5:
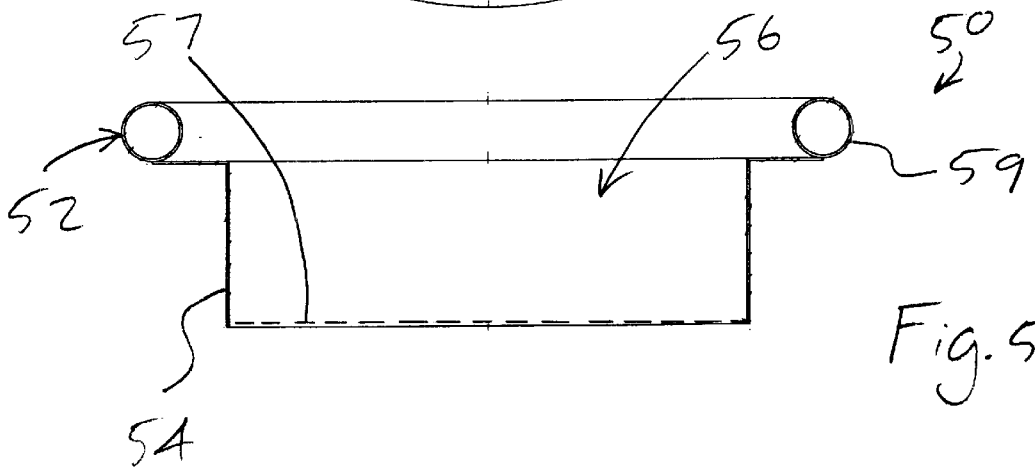
Figure 6:
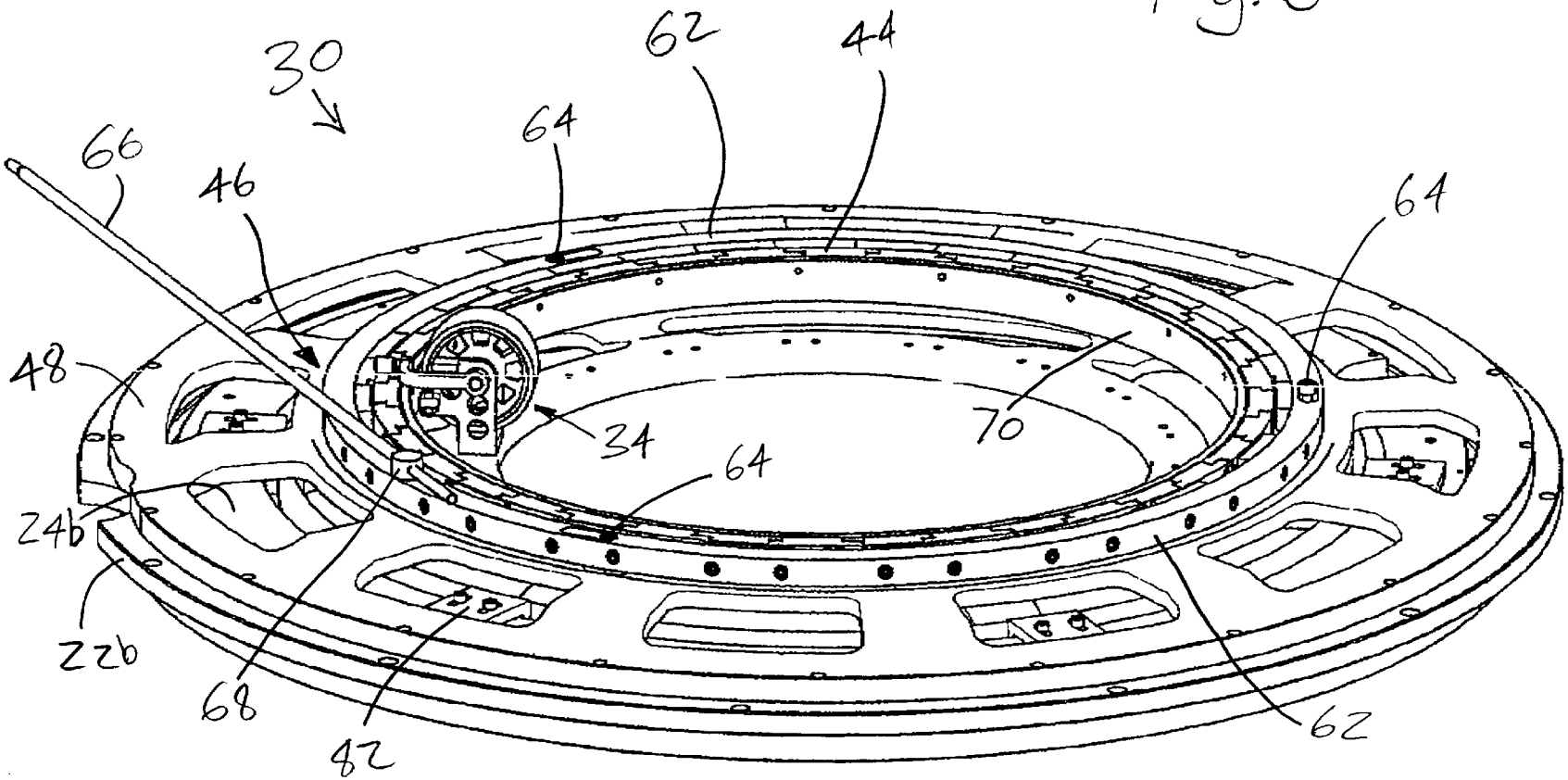
Figure 7:
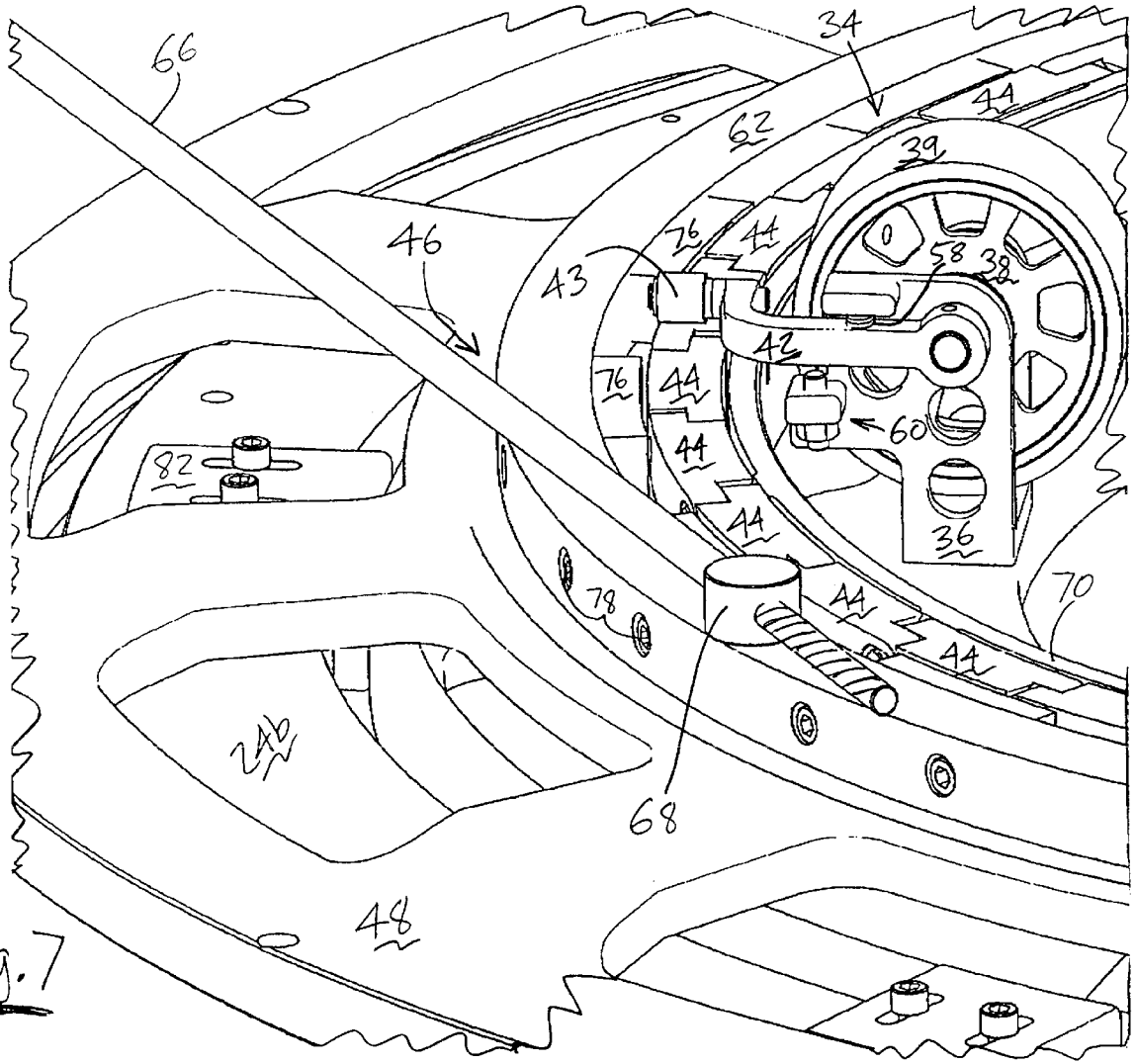
Figure 8:
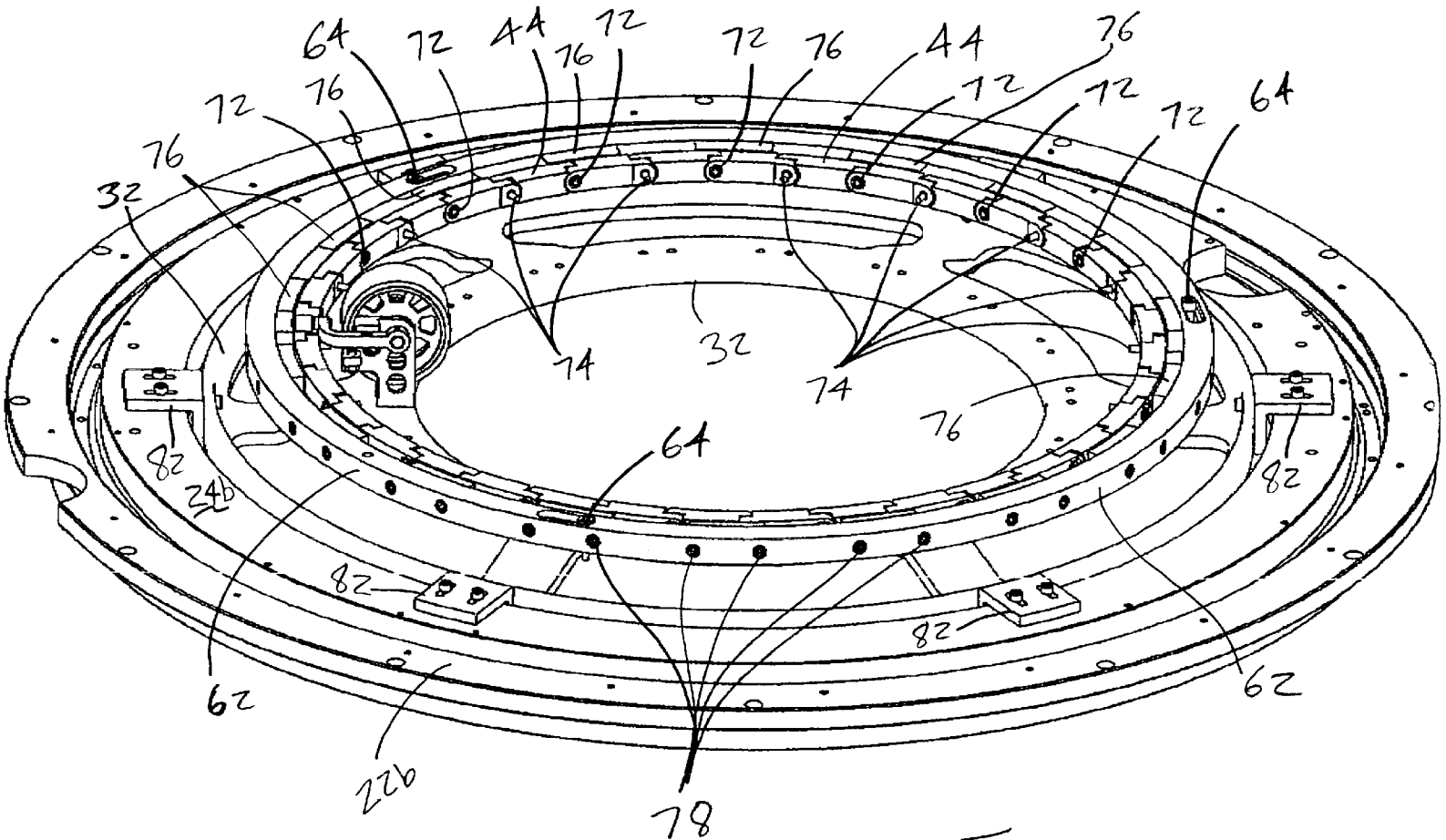
Figure 7:
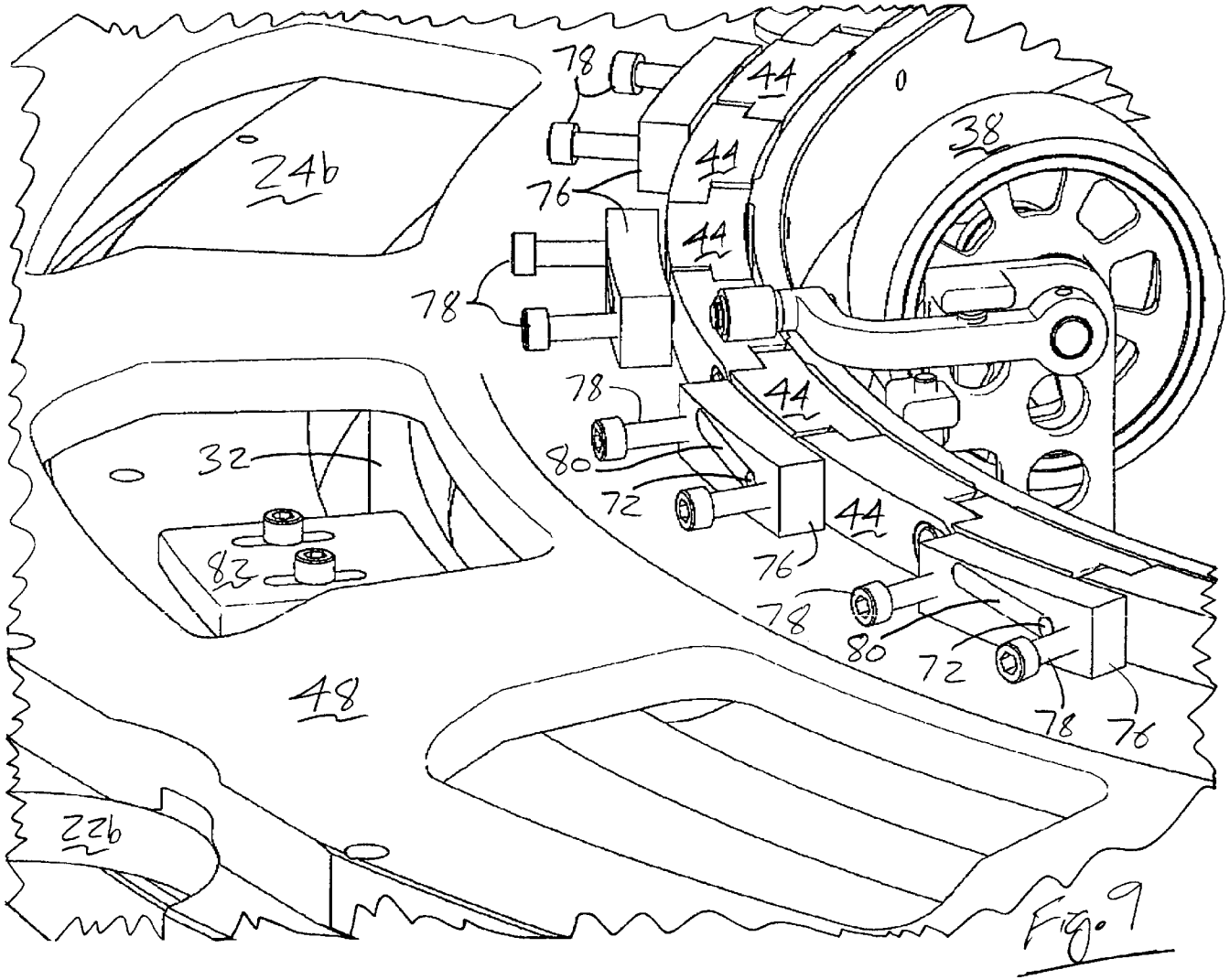
Figure 10:
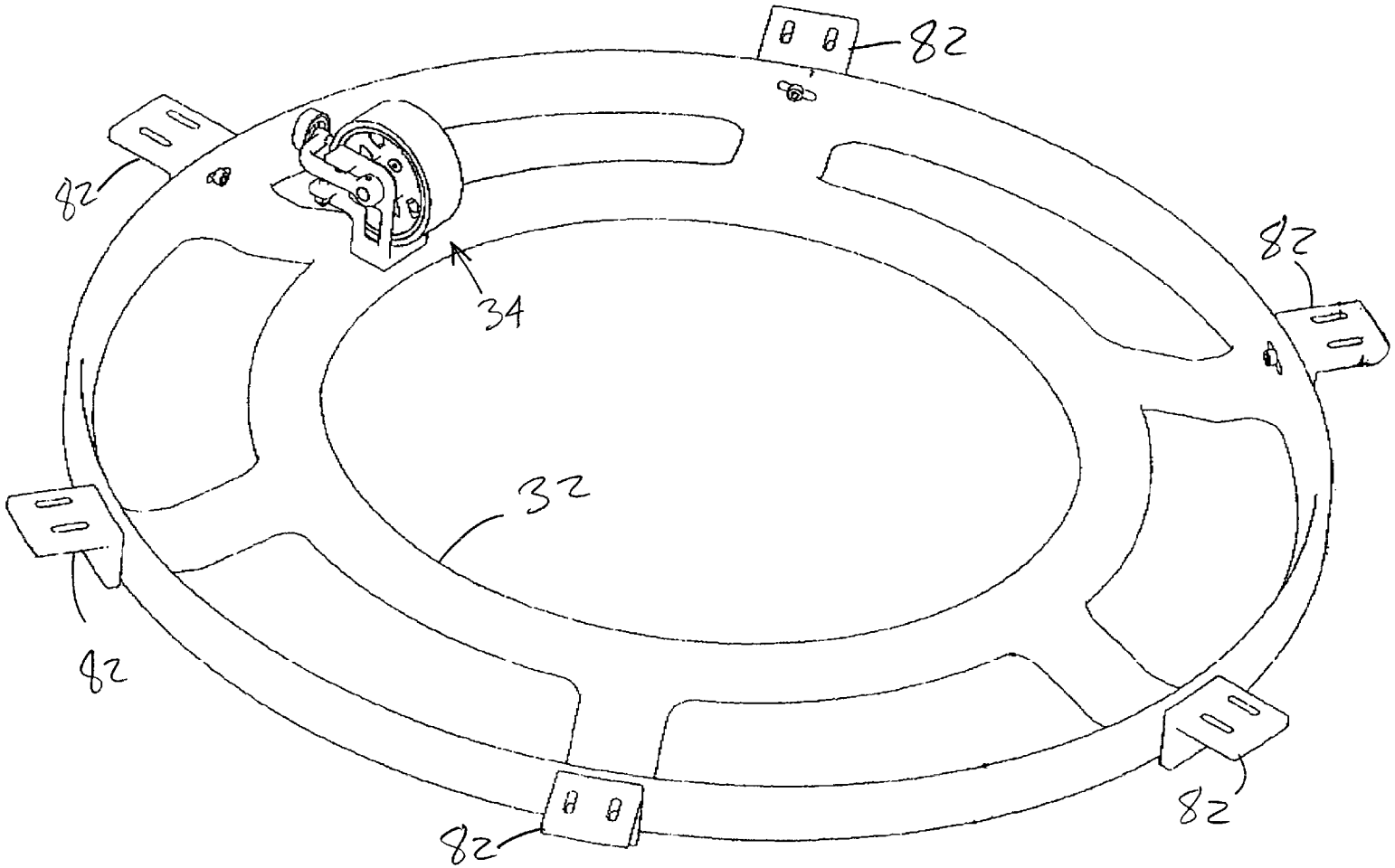
Figure 11:
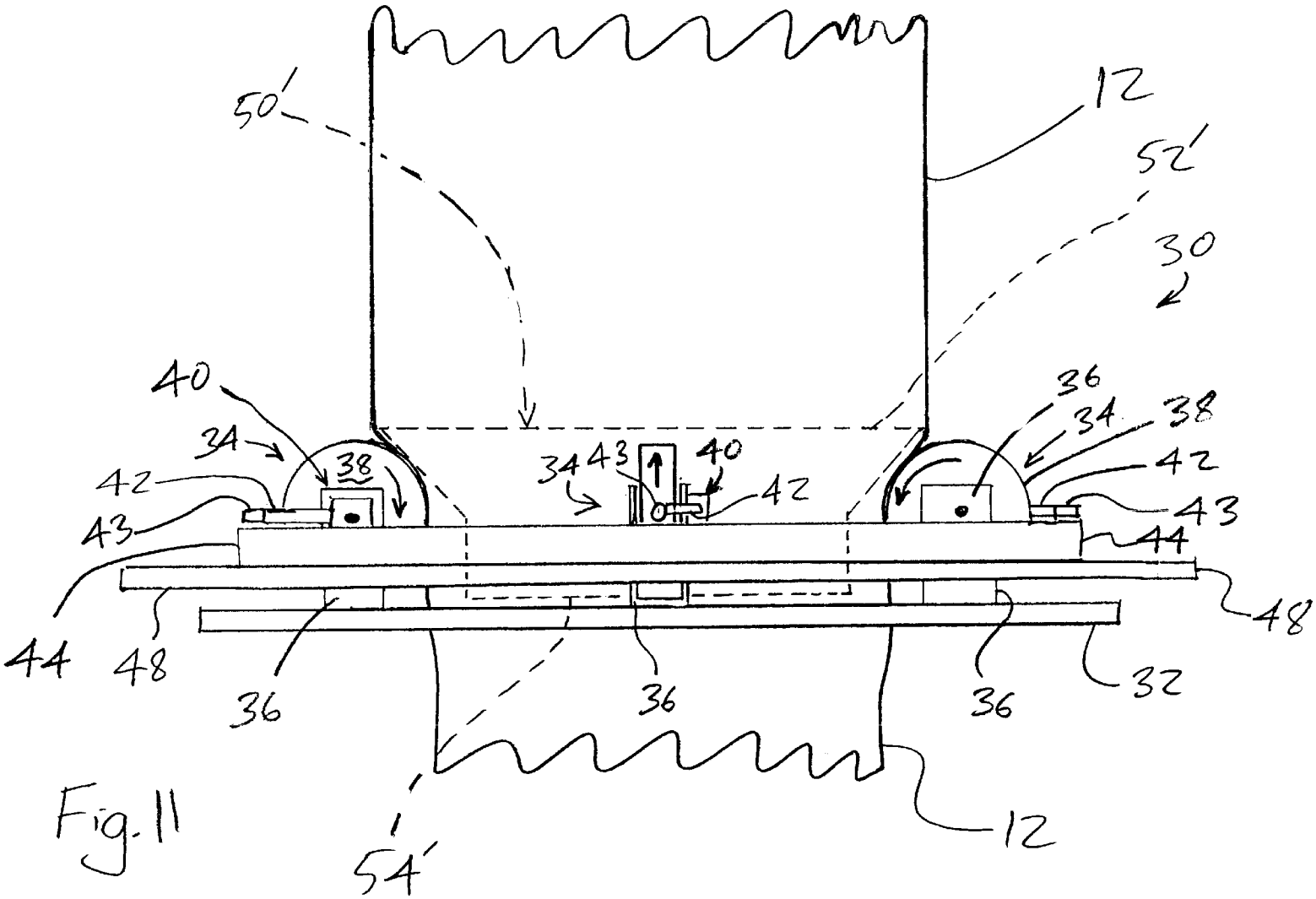
Figure 12:
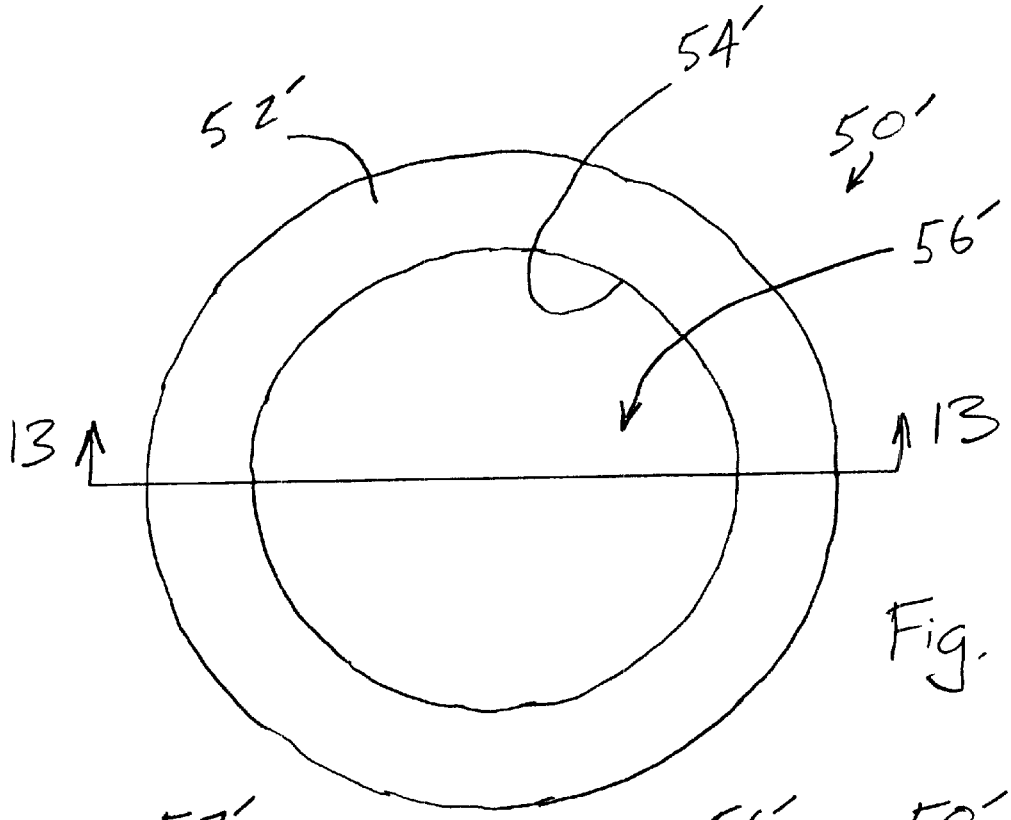
Figure 13:
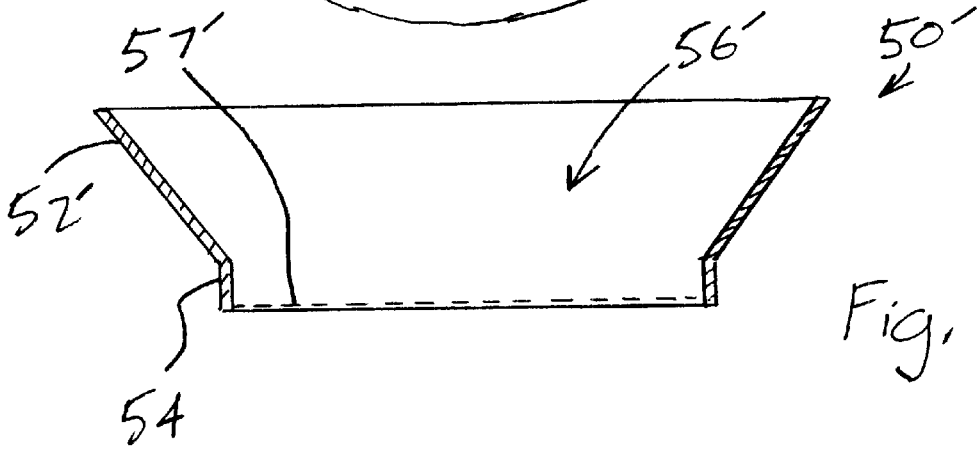

Having thus described the invention in general terms, reference will now be made to the accompanying drawings, which are not necessarily drawn to scale, and wherein:

FIG. 1 diagrammatically illustrates portions of a circular knitting machine, in accordance with an exemplary embodiment of the present invention;

FIG. 2 diagrammatically illustrates a takedown unit, in accordance with the exemplary embodiment of the present invention;

FIG. 3 diagrammatically illustrates portions of the takedown unit of FIG. 2 in greater detail;

FIG. 4 is an isolated, top plan view of a guide mechanism of the takedown unit of FIG. 2;

FIG. 5 is a cross-sectional view of the guide mechanism taken along line 5—5 of FIG. 4;

FIG. 6 illustrates portions of the takedown unit of FIG. 2 in greater detail;

FIG. 7 is an enlarged view of a portion of FIG. 6;

FIG. 8 is like FIG. 6, except that FIG. 8 does not include the stationary frame, adjustment rod and adjustment lug that are shown in FIG. 6;

FIG. 9 is like FIG. 7, except that FIG. 9 does not include the adjustment ring, adjustment rod, and adjustment lug that are shown in FIG. 7;

FIG. 10 is like FIGS. 6 and 8, except that FIG. 10 only includes the representative roller assembly, the rotating frame, and a series of mounting brackets;

FIG. 11 is like FIG. 4, except for including a guide mechanism in the form of a funnel, in accordance with another embodiment of the present invention;

FIG. 12 is an isolated, top plan view of the guide mechanism of FIG. 11; and FIG. 13 is a cross-sectional view of the guide mechanism taken along line 13—13 of FIG. 12.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

One aspect of the present invention is a knitting machine that incorporates the improved takedown unit of the present invention, and another aspect of the present invention is the takedown unit in isolation, with such a takedown unit preferably, but not necessarily, being retrofittable onto an existing and conventional knitting machine. Accordingly, portions of a circular knitting machine 10, to which the improved takedown unit of the present invention can be installed, are diagrammatically illustrated in FIG. 1.

Referring to FIG. 1, the knitting machine 10 of the exemplary embodiment of the present invention is for forming knitted fabric 12 and includes a stationary frame 14 for supporting a rotating knitting cylinder 16 above a fabric receiving tub 18. The knitting cylinder 16 includes a knitting assembly (not shown) having an upper needle bed and a rotating upper race 24*a* for forming the tubular knitted fabric 12. The tubular knitted fabric 12 is delivered from the knitting cylinder 16 in a hanging state. The hanging fabric 12 rotates with the knitting cylinder 16 and is pulled and/or guided down therefrom by a takedown unit (not shown in FIG. 1) so that the tubular knitted fabric travels downward along a fabric travel path that is diagrammatically illustrated by arrows 20 in FIG. 1.

The illustrated frame 14 includes stationary portions that are preferably annular, extend around the fabric travel path, are positioned below the knitting cylinder 16, and can be characterized as upper and lower beds 22*a* and 22*b*. The illustrated frame 14 also includes or rotatably carries rotatable portions that are also preferably annular, extend around the fabric travel path, and are positioned below the knitting cylinder 16, and these rotatable portions can be characterized as upper and lower races 24*a* and 24*b*. In accordance with the exemplary embodiment of the present invention, portions of the takedown unit (not shown in FIG. 1) are respectively mounted to one of the upper and lower beds 22*a* and 22*b*, and other portions of the takedown unit are mounted to a respective one of the upper and lower races 24*a* and 24*b*, as will be discussed in greater detail below.

In accordance with the exemplary embodiment of the present invention, the knitting cylinder 16 and races 24*a* and 24*b* are preferably both driven by a rotating vertical shaft 26, such that the knitting cylinder and races preferably rotate in the same direction and at substantially the same rotational speed during the production of the knitted fabric 12. The vertical shaft 26 is rotated by a frame-mounted motor 27 via pulleys and a belt 28, or the like. The mechanisms by which the knitting cylinder 16 and races 24*a* and 24*b* are linked to and driven by the vertical shaft can be readily provided by those of ordinary skill in the art; therefore, they are not shown in FIG. 1. In accordance with an alternative embodiment of the present invention, the knitting cylinder 16 and races 24*a* and 24*b* are not all driven by the common rotating vertical shaft 26, and each is driven by completely separate drive means. Nonetheless, even in this alternative embodiment, it is preferred for the knitting cylinder 16 and races 24*a* and 24*b* to rotate in the same direction and at substantially the same rotational speed during the production of the knitted fabric 12, although variations are within the scope of the present invention.

The takedown unit 30 of the exemplary embodiment of the present invention is schematically and partially illustrated in FIGS. 2–3. As will be discussed in greater detail below, the takedown unit 30 draws down the hanging fabric 12 from the knitting cylinder 16, and the conventional fabric receiving tub 18 may be positioned after the takedown unit for collecting the fabric drawn down by the takedown unit. Alternatively, the tub 18 may be replaced with other collecting devices, such as a conventional reel for winding up the fabric 12 drawn down by the takedown unit 30.

As best understood with reference to FIG. 2, the takedown unit includes a rotating frame 32 that is preferably annular and extends around the fabric travel path, and is fixedly mounted to, and rotates with, the race 24*a* or 24*b* (FIG. 1), or the like. In accordance with the exemplary embodiment of the present invention, the rotating frame 32 is mounted to the race 24*b*, although it is within the scope of the present invention for the rotating frame 32 to be mounted to the race 24*a*, or for the rotating frame 32 to be rotated in another manner. Multiple roller assemblies 34 are mounted to the rotating frame 32 for rotating with the race 24*b*. In accordance with the exemplary embodiment of the present invention, a series of eighteen roller assemblies 34 are uniformly arranged on the rotating frame 32, although fewer are shown in the figures herewith and variations are within the scope of the present invention.

In accordance with the exemplary embodiment, each roller assembly 34 includes a mounting bracket 36, which may preferably be L-shaped. The base of the bracket 36 is mounted to the rotating frame 32 and a takedown roller 38 is rotatably mounted to an upright portion of the bracket 36. The takedown rollers 38 are arranged radially around the periphery of the circular knitting machine 10 to engage the knitted fabric 12. The driven takedown rollers 38 are faced with rubber 39 (FIG. 7) for frictionally engaging the fabric 12 and drawing it down without damaging the fabric surface.

Each of the roller assemblies 34 is preferably equipped with an actuator 40 for driving the takedown roller 38 of the roller assembly 34. In accordance with the exemplary embodiment of the present invention, each actuator 40 is in the form of a ratchet mechanism/mechanism with a one-way clutch, or the like, that includes a lever 42 and an output shaft for rotating substantially only in one direction in response to reciprocation of the lever. For each of the roller assemblies 34, the output shaft of the associated actuator 40 drives (e.g., is "keyed to") the takedown roller 38 so that the takedown roller rotates about its axis of rotation in response to the reciprocation of the associated lever 42. The takedown rollers 38 are preferably solely rotated in the "inward" direction so as to draw down the fabric 12. For each roller assembly 34, a second one-way clutch is preferably fixed in the bracket 36 to prevent the roller 38 from rotating in the "outward" direction while the lever 42 is returning to its starting position/not driving the roller, so as to prevent the roller from moving the fabric in the wrong, e.g. upward, direction.

As best understood with reference to FIG. 3, each of the levers 42 preferably includes a cam follower 43 in the form of a roller, for engaging and rolling along upper surfaces of a series of cams 44 in a manner that causes the reciprocation of the lever. In accordance with the exemplary embodiment of the present invention, the levers 42 and cams 44 are preferably arranged so that the levers reciprocate in an upright direction. However, in accordance with alternative embodiments of the present invention, the reciprocating may be radial or in other directions. As will be discussed in greater detail below, it is preferable for each of the levers 42 to be urged into a starting (e.g., lower) position by a respective return spring, and for the starting position of each of the levers 42 to be controlled by the cams.

The series of cams 44 extends around the tubular knitted fabric 12, and the cams are preferably mounted to a stationary frame 48 that is annular, extends around the fabric travel path, and is fixedly mounted to one of the upper and lower beds 22*a* and 22*b* (FIG. 1), or the like, of the knitting machine 10. In accordance with the exemplary embodiment of the present invention, the stationary frame 48 is mounted to the bed 22*b*, as is shown in FIG. 6. Conversely, it is within the scope of the present invention for the stationary frame 48 to be mounted to the bed 22*a*, or for the stationary frame 48 to be held in another manner.

The illustration of the cams 44 is very schematic in FIG. 2, but they are more clearly shown in FIG. 3. Also shown in FIG. 3 is a portion of an adjustment mechanism 46 that is for adjusting the throw of the cams 44. Adjusting the cam throw adjusts the rotation of the takedown rollers 38, as will be discussed in detail below with reference to FIGS. 6–9.

In accordance with the exemplary embodiment of the present invention, while the knitting machine 10 having the takedown unit 30 mounted thereto operates to form the knitted fabric 12, there is relative rotation around the fabric travel path between the actuators 40 and the cams 44, and the cam followers 43 roll along the generally undulating upper surface of the series of cams so that the actuators are actuated and thereby rotate the takedown rollers 38. Referring to FIG. 2, preferably each actuator 40 is actuated many times by the series of cams 44 when the rotating frame 32, which carries the actuators 40 and the takedown rollers 38, rotates 360 degrees relative to the stationary frame 48, which carries the cams 44. In accordance with the exemplary embodiment of the present invention, for each takedown roller 38 and its respective actuator 40, the takedown roller is substantially directly driven by the actuator so that while the lever 42 of the actuator is being raised, the takedown roller is driven by the actuator and thereby rotating, and while the lever is being lowered, the actuator does not drive the takedown roller. For each takedown roller 38 and its respective actuator 40, preferably the direct drive relationship is such that with each degree of angular rotation of the lever 42 in the upper direction, there is substantially contemporaneously the same degree of angular rotation of the takedown roller. Preferably, each takedown roller 38 is prevented from counterrotating by the one-way clutch, or the like, fixed in the bracket 36 supporting the takedown roller.

In accordance with the exemplary embodiment of the present invention, and as best understood with reference to FIG. 2, the rubber facing 39 (which is shown in FIG. 7 and has a relatively high coefficient of friction) of the rotating takedown rollers 38 draws down the hanging tubular fabric 12 by interacting with a guide mechanism 50 (which has a relatively low coefficient of friction, i.e. a lower coefficient of friction than the rubber facing 39 of the takedown rollers 38). The guide mechanism 50 is positioned within the interior of the hanging tubular fabric 12 so that the relatively low-friction guide mechanism spreads the fabric into contact with the relatively high-friction takedown rollers 38. That is, the guide mechanism 50 interacts with the takedown rollers 38 to define a plurality of nips through which the tubular fabric 12 extends, so as to at least partially define the fabric travel path. Accordingly, the guide mechanism 50 is hidden from view in FIG. 2 and is therefore shown in broken lines.

The guide mechanism 50 of the exemplary embodiment of the present invention is preferably not rigidly connected to any structure of the circular knitting machine 10 or takedown unit 30, so that the guide mechanism floats within the interior of the tubular fabric 12. This floating advantageously seeks to facilitate an equalization of the frictional forces applied to the fabric 12 by the takedown unit 30, so as to promote optimal control over fabric production. Alternatively, the guide mechanism 50 may be rigidly connected to structure of the knitting machine 10. Other guide mechanisms are within the scope of the present invention, such as guide mechanisms including contrast rollers mounted for being located on the inside of the knitted fabric 12, and another guide mechanism of the present invention is illustrated in FIGS. 11–13, as will be discussed in greater detail below.

Referring also to FIGS. 4–5, which are respectively a top plan view and a representative vertical cross-sectional view of the guide mechanism 50, the guide mechanism preferably includes an annular upper portion 52 that is encircled by the hanging tubular fabric 12 and contemporaneously interacts with all of the takedown rollers 38 to define the nips, such that the nips are preferably positioned above the rotational axes of the takedown rollers 38. In FIG. 2, the nips are defined at the tops of the takedown rollers. The guide mechanism 50 preferably also includes an annular lower portion 54 extending downwardly from the upper portion 52. The upper portion 52 defines a larger diameter than the lower portion 54 such that the upper portion is positioned above the takedown rollers 38 and the lower portion extends downwardly between the takedown rollers, so that the lower portion 54 of the guide mechanism helps to generally maintain the preferred position (shown in FIG. 2) of the guide mechanism. Preferably, the preferred position of the guide mechanism 50 is maintained by virtue of the center of gravity of the guide mechanism being below the rotational axes of the takedown rollers 38.

As indicated above, the guide mechanism 50 is positioned within the knitted fabric 12 to urge the fabric into contact with the driven takedown rollers 38. Preferably, weight can be added to or removed from the guide mechanism 50, such as by placing weights into or removing weights from a cavity 56 (FIGS. 4–5) defined by the guide mechanism, so as to adjust the tension that the takedown unit 30 imparts upon the fabric 12. As illustrated by broken lines in FIG. 5, the cavity 56 can be partially defined by an optional bottom wall 57 of the guide mechanism 50, so that weights can be readily held within the cavity 56. Other options for adjusting the weight of the guide mechanism 50 are also within the scope of the present invention. For example, the guide mechanism 50 to be used can be selected from multiple different guide mechanisms that have been manufactured so as to have different masses/weights. Preferably, the guide mechanism 50 is made of a smooth material (i.e., which has a relatively low coefficient of friction) such as spun or cast metal; alternatively, a plastic material or other material may be used.

In accordance with one method of operation of the exemplary embodiment of the present invention, while the takedown unit 30 is drawing down the fabric 12 and the guide mechanism 50 is floating within the interior of the fabric being drawn down, the interior surface of an annular section of the fabric that encircles the guide mechanism is preferably in contact with the guide mechanism for substantially 360 degrees around the guide mechanism. At the same time, the takedown rollers 38 contact a majority of the outer surface of that same annular section of the fabric 12.

Some components of the takedown unit 30 are shown in greater detail in FIG. 6 and also in FIG. 7, which is an enlarged view of a portion of FIG. 6. For example, for the roller assembly 34 illustrated in FIG. 7 (with this roller assembly 34 being representative of the other roller assemblies), the lever 42 is urged downward against the cams 44 by a return spring 58, and the starting position of the lever 42 is optionally controlled by an adjustable stop 60. The stop 60 can be omitted so that the starting position of the lever 42 is controlled by the cams 44. Whereas the illustrated return spring 58 is a compression spring mounted above the lever 42, the spring could alternatively be a tension spring mounted below the lever, and other means for maintaining the levers in close proximity to the cams are also within the scope of the present invention.

The adjustment mechanism 46 that is for adjusting the throw of the cams 44 is shown in greater detail in FIGS. 6–7. The adjustment mechanism 46 preferably includes an adjustment ring 62 that extends around the series of cams 44 and is mounted upon the upper surface of the stationary frame 48 for radial/rotational adjustment relative to the series of cams and the stationary frame. As shown in FIG. 6, upright bolts 64 extend through upright slots in the adjustment ring 62 so as to both allow and limit the rotation of the adjustment ring. Alternatively, the adjustment ring 62 is moveably retained in its location by a series of locating rollers (not shown) that are arranged around the periphery of the adjustment ring for allowing the rotation of the adjustment ring.

In accordance with the exemplary embodiment, an adjustment rod 66 is rotatably mounted to the frame 14 (FIG. 1) by a bracket (not shown) such that the adjustment rod is allowed to rotate about its elongate axis, but is otherwise substantially restricted from moving. The adjustment rod 66 threadedly engages a threaded bore of an adjustment lug 68 that is pivotably mounted to the adjustment ring 62. The adjustment rod 66 is threaded farther into and out of the threaded bore of the lug 68 to cause the adjustment ring 62 to rotate relative to the cams 44 and thereby adjust the throw of the cams, as will be discussed in greater detail below with reference to FIG. 9. The adjustment rod 66 also functions to "lock" the adjustment ring 62 in place. Other mechanisms for locking and rotating the position of the adjustment ring 62 and/or adjusting the throw of the cams 44 are also within the scope of the present invention.

The adjustment rod 66 preferably extends to outside the closed-in takedown area of the knitting machine 10, so that the throw of the cams 44 can advantageously be adjusted while the knitting machine 10 is in operation, to change the takedown rate in conjunction with knitting changes, as will be discussed in greater detail below. In accordance with the exemplary embodiment of the present invention, the adjustment mechanism 46 is a mechanical means for changing the takedown rate while the knitting machine is operating. In accordance with another embodiment of the present invention, the adjustment mechanism 46 further includes an electromechanical link/actuator for facilitating automatic takedown rate adjustments in response to signals from a yarn input/feed rate measuring device, so that the takedown tension may be automatically increased or decreased in response to changes in the feed rate of the yarn.

As best understood with reference to FIG. 7, the cams 44 are mounted to the outer surface of an upright hub 70 of the stationary frame 48. The cams 44 are preferably attached to respective flat faces cut on the outer diameter/surface of the upright hub 70. Referring to FIG. 8, which is like FIG. 6 except that the stationary frame 48, adjustment rod 66 and adjustment lug 68 are removed, each cam 44 preferably includes two links with opposite inclinations (also see FIG. 3). For each cam 44, adjacent ends of its links are pivotably connected to one another by a pivot pin 72, or the like, which may be in the form of a pin retained with a shoulder and snap ring, or the like. The pivot pins 72 are not mounted to the upright hub 70 (FIG. 7) and are movable relative thereto. The opposite ends of each cam 44, i.e., the ends of the links of a cam that are at opposite ends of the cam, are each movably mounted to the upright hub 70 by fasters, such as screws 74, or the like, that extend through slots in the cams and are screwed into the upright hub 70 of the stationary frame 48. Each of the screws 74 movably secures two adjacent cams 44 to the hub 70. Accordingly, the cams 44 are preferably connected to provide an unbroken, substantially smooth, continuous upper cam surface or track. In accordance with an alternative embodiment of the present invention, the multiple cams 44 are not connected to one another in a manner that provides an unbroken, substantially smooth, continuous cam surface or track. That is, other cam arrangements are also within the scope of the present invention.

The cams 44 are connected such that the elevation of the middle or lobe portion of each cam, i.e., the portions of the cams proximate the pivots 72, can be changed while the elevation of the portions of the cams proximate the screws 74 remains substantially unchanged. Accordingly, the throw of the cams 44 can be adjusted by changing the elevation of the portions of the cams proximate the pivots 72. The throw of the cams 44 is preferably adjusted by moving the adjustment ring 62 in the manner discussed above with reference to FIGS. 6–7. Regarding this adjustment more specifically, in accordance with the exemplary embodiment of the present invention, adjustment blocks 76 are rigidly mounted to the inside surface of the adjustment 62 ring by fasteners, such as bolts 78, or the like, and these adjustment blocks move with the adjusting ring 62 to ply a role in adjusting the cams 44.

Referring to FIG. 9, which is like FIG. 7 except that the adjustment ring 62, adjustment rod 66 and adjustment lug 68 are removed, the pivot pins 72 of the cams 44 protrude radially outward from the cams and respectively extend into slots 80 cut at an angle in the adjusting blocks 76 that are rigidly attached to the adjusting ring 62. Rotating the adjusting ring 62 in the manner discussed above, or by other means, causes the pivot pins 72 to travel along the slots 80 so as to change the throw of the cams 44. If the cams 44 are adjusted to define a larger throw/higher inclination, a greater driving motion is provided/imparted to the cam followers 43, which increases the rotating of the takedown rollers 38. Conversely, lesser throw/inclination of the cams 44 directs a smaller driving motion to the cam followers 43 and thereby the takedown rollers 38.

FIG. 10 is like FIGS. 6–7, except that FIG. 10 only shows the rotating frame 32, the representative roller assembly 34, and a series of brackets 82 by which the rotating frame is preferably mounted to the lower race 24*b* (FIGS. 1 and 8). As best understood with reference to FIG. 8, the rotating frame 32 is mounted to the race 24*b* by the brackets 82, although other attachment schemes are within the scope of the present invention.

In accordance with the exemplary embodiment of the present invention, the takedown rollers 38 may be actuated by the actuators 40 at a rate of about fifteen cycles per second in a twenty-four inch diameter knitting machine 10 with eighteen feeds, and eighteen cams 44 and eighteen takedown rollers 38, operating at a top speed of about fifty rpm. Preferably the arrangement of the roller assemblies 34 and cams 44 is coordinated such that the actuators 40 operate synchronously to rotate the takedown rollers 38 synchronously. However, the rate of actuation, as well as the number of takedown rollers 38 and other parameters, may be varied. For example, larger diameter knitting machines may have more roller assemblies 34 and cams 44, and smaller diameter knitting machines may have less roller assemblies 34 and cams 44. It is not necessary for the number of takedown rollers 38 and cams 44 to correspond to the number of feeds on the knitting machine 10.

In accordance with one aspect, the present invention advantageously provides for easy adjustment of the takedown rate of the knitted fabric 12 while the knitting machine 10 is in operation. Additionally, the takedown unit 30 of the present invention may reduce the amount of tension needed on the fabric 12 for takedown, thus allowing the fabric to be drawn down from the knitting cylinder 16 with minimum force and pressure on the fabric, so that the knitting assembly can knit "naturally." Also, preferably the tension in the fabric 12 that results from the operation of the takedown unit is not excessive, and is substantially similar in all portions of the fabric being formed, to advantageously provide a uniform knitted fabric. That is, the present invention advantageously seeks to avoid or minimize the introduction of defects and distortion in the knitted fabric 12, such as pinching or marking of fabrics made with fragile polymer fibers such as polypropylene or yarn such as lycra. The present invention also seeks to avoid the introduction of "tiger stripe" defects in pile fabric, which can result in an undesired appearance after a finish is applied to the fabric. The present invention also seeks to avoid the introduction of pinched points, slippage marks and fold defects caused by the use of pinch rollers that increase the width of the knitting tube 12 and thereby force it to contact the inside of the knitting cylinder. The advantages of the present invention also include the possibility of using less power than a traditional takedown unit. It is also expected that the takedown unit 30 of the present invention may be less expensive than prior pinched-type takedown units by eliminating the magnetic takedown clutch and big ring gear that drives the traditional pinch rolls. Another advantage is that the present invention preferably keeps the knitting fabric 12 in a round tubular form in the vicinity of the takedown unit 30, which allows for the diameter and lower frame size to be decreased in large diameter knitting machines. Additionally, the interaction between the guide mechanism 50 and the driven takedown rollers 38 can hold the fabric 12 in a brake condition when the knitting machine 10 is not rolling. Preferably, the one-way clutches, or the like, fixed in the brackets 36 serve as brakes that prevent counterrotation of the takedown rollers 38.

Another embodiment of the present invention is identical to the exemplary embodiment, except that a generally funnel-shaped guide mechanism 50' (FIGS. 11–13) is used in place of the guide mechanism 50 of FIGS. 2 and 4–5. The guide mechanism 50' is structurally like, and functions like, the guide mechanism 50 of the exemplary embodiment, except for variations noted and variations that will be apparent to those of ordinary skill in the art in view of this disclosure.

The guide mechanism 50' is illustrated by broken lines in FIG. 11 because it is hidden from view. Referring also to FIGS. 12–13, which are respectively a top plan view and a representative vertical cross-sectional view of the guide mechanism 50', it preferably includes an annular upper portion 52' that is encircled by the hanging tubular fabric 12 and contemporaneously interacts with all of the takedown rollers 38 to define the nips. The upper portion 52' is preferably in the form of a truncated cone. For the illustrated guide mechanism 50', with respect to each of the takedown rollers 38, the nip is preferably located above the rotational axis of the takedown roller 38, and most preferably the nip is defined at a position that is above the rotational axis of the takedown roller and below the top of the takedown roller.

The guide mechanism 50' preferably also includes an annular lower portion 54' extending downwardly from the upper portion 52'. The upper portion 52' defines a larger diameter than the lower portion 54' such that at least part of the upper portion is positioned above the rotational axes of the takedown rollers 38 and the lower portion extends downwardly between the takedown rollers, so that the lower portion 54' of the guide mechanism helps to generally maintain the preferred position (shown in FIG. 11) of the guide mechanism. Preferably, the preferred position of the guide mechanism 50' is maintained by virtue of the center of gravity of the guide mechanism being below the rotational axes of the takedown rollers 38.

Preferably, weight can be added to or removed from the guide mechanism 50', such as by placing weights into or removing weights from a cavity 56' defined by the guide mechanism, so as to adjust the tension that the takedown unit 30 imparts upon the fabric 12. As illustrated by broken lines in FIG. 13, the cavity 56' can be partially defined by an optional bottom wall 57' of the guide mechanism 50', so that weights can be readily held within the cavity 56'. Other options for adjusting the weight of the guide mechanisms are also within the scope of the present invention, as discussed above. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A circular knitting machine for forming tubular fabric, the circular knitting machine comprising:

a frame supporting a knitting cylinder for forming the tubular fabric such that the tubular fabric hangs downward along a fabric travel path from the knitting cylinder;

a takedown unit mounted to the frame below the knitting cylinder for drawing down the hanging tubular fabric, the takedown unit including:

a plurality of rollers that at least partially extends around the fabric travel path, wherein the rollers are mounted for respectively rotating about rotational axes of the rollers to draw down the hanging tubular fabric, a plurality of cams that extends at least partially around the fabric travel path, with the cams and the rollers being mounted to allow relative rotation therebetween, with said relative rotation between the cams and the rollers being around the fabric travel path, and an actuator positioned for engaging the cams in response to said relative rotation between the rollers and the cams, so that the cams actuate the actuator a plurality of times for each 360 degrees of said relative rotation between the rollers and the cams, with each actuation including a reciprocating motion of at least a portion of the actuator, wherein the actuator is operative for translating the reciprocating motion into the rotating of at least one of the rollers about its rotational axis.

2. A circular knitting machine according to claim 1, wherein the reciprocating motion is upright.

3. A circular knitting machine according to claim 1, wherein the actuator includes a lever and an output shaft for rotating substantially only in one direction in response to reciprocation of the lever, the output shaft is connected to the at least one roller for causing the rotating of the at least one roller about its rotational axis, and the lever follows at least portions of the cams in a manner that causes the reciprocation of the lever in response to said relative rotation between the rollers and the cams.

4. A circular knitting machine according to claim 3, wherein the lever reciprocates between first and second positions, and a spring biases the lever toward the first position.

5. A circular knitting machine according to claim 1, wherein the takedown unit includes a plurality of actuators respectively associated with the rollers, wherein for each actuator and a respective roller, the cams actuate the actuator a plurality of times for each 360 degrees of said relative rotation between the rollers and the cams, with each actuation including a reciprocating motion of at least a portion of the actuator, and the actuator is operative for translating the reciprocating motion into the rotating of the roller about its rotational axis.

6. A circular knitting machine according to claim 5, wherein the cams and the actuators are operative so that the actuators operate synchronously to rotate the rollers synchronously.

7. A circular knitting machine according to claim 1, further comprising a guide mechanism for being encircled by the hanging tubular fabric and interacting with the rollers to define a plurality of nips for having the tubular fabric extend therethrough, and for spreading the hanging tubular fabric for facilitating engagement of the rollers against the tubular fabric.

8. A circular knitting machine according to claim 7, wherein the guide mechanism is not rigidly connected the frame of the circular knitting machine so that the guide mechanism floats within the interior of the tubular fabric.

9. A circular knitting machine according to claim 7, wherein the guide mechanism includes upper and lower portions, with the upper portion having a larger diameter than the lower portion.

10. A circular knitting machine according to claim 7, wherein exterior surfaces of the rollers engage the tubular fabric, an exterior surface of the guide mechanism engages the tubular fabric, and the exterior surfaces of the rollers have a higher coefficient of friction than the exterior surface of the guide mechanism.

11. A circular knitting machine according to claim 7, wherein the guide mechanism includes an annular portion for being encircled by the hanging tubular fabric and contemporaneously interacting with the rollers to define the nips.

12. A circular knitting machine according to claim 11, wherein the nips are positioned above the rotational axes of the rollers.

13. A circular knitting machine according to claim 11, wherein annular portion of the guide mechanism is an upper portion and the guide mechanism further includes an annular lower portion extending downwardly from the upper portion, with the upper portion defining a larger diameter than the lower portion such that the upper portion is positioned above the rollers and the lower portion extends downwardly between the rollers.

14. A circular knitting machine according to claim 1, wherein the cams are adjustable between at least first and second configurations, with the reciprocating motion imparted to the actuator by the cams while the cams are in the first configuration defining a first maximum displacement, and the reciprocating motion imparted to the actuator by the cams while the cams are in the second configuration defining a second maximum displacement that is greater than the first maximum displacement, such that the actuator rotates the at least one roller to a greater degree while the cams are in the second configuration than while the cams are in the first configuration.

15. A circular knitting machine according to claim 14, further comprising an adjuster that extends at least partially around the fabric travel path, with the adjuster and the cams being mounted to allow relative rotation therebetween, with the relative rotation between the adjuster and the cams being around the fabric travel path, and the adjuster and the cams being linked to one another so that the cams synchronously move toward the first configuration in response to relative rotation between the adjuster and the cams in a first direction around the fabric travel path, and so that the cams synchronously move toward the second configuration in response to relative rotation between the adjuster and the cams in a second direction around the fabric travel path, wherein the first direction around the fabric travel path is opposite from the second direction around the travel path.

16. A circular knitting machine according to claim 15, further comprising a rod that is rotatably mounted to the frame, with the rod being threaded and threadedly engaging a threaded bore of the adjuster for being threaded farther into and out of the threaded bore for causing the relative rotation between the adjuster and the cams in the first and second directions around the fabric travel path.

17. A circular knitting machine according to claim 1, further comprising a fabric receiving tub or a reel for collecting the fabric drawn down by the takedown unit.

18. A takedown unit for a circular knitting machine that includes a knitting cylinder for forming tubular fabric such that the tubular fabric hangs downward along a fabric travel path from the knitting cylinder, the takedown unit comprising:

a plurality of rollers mounted to a frame so that the plurality of rollers can extend at least partially around the fabric travel path, wherein the rollers are mounted for respectively rotating about rotational axes of the rollers for drawing down the hanging tubular fabric, and a guide mechanism for being within and encircled by the hanging tubular fabric, and for interacting with the rollers to define a plurality of nips for having the tubular fabric extend therethrough so as to at least partially define the fabric travel path and spread the hanging tubular fabric for facilitating engagement of the rollers against the tubular fabric, wherein the nips are positioned above the rotational axes of the rollers.

19. A takedown unit according to claim 17, wherein the guide mechanism includes an annular portion for being encircled by the hanging tubular fabric and contemporaneously interacting with all of the rollers to define the nips.

20. A takedown unit according to claim 19, wherein annular portion is an upper portion and the guide mechanism further includes an annular lower portion extending downwardly from the upper portion, with the upper portion defining a larger diameter than the lower portion such that the upper portion is positioned above the rollers and the lower portion extends downwardly between the rollers.

21. A takedown unit according to claim 17, wherein the takedown unit is in combination with the circular knitting machine and the tubular fabric, and wherein the guide mechanism is within the interior of the tubular fabric, and the guide mechanism is not rigidly connected to any structure of the circular knitting machine so that the guide mechanism floats within the interior of the tubular fabric.

22. A combination according to claim 21, wherein the interior surface of an annular section of the tubular fabric that encircles the guide mechanism is in contact with the guide mechanism for substantially 360 degrees around the guide mechanism, and the rollers contact a majority of the outer surface of the annular section of the tubular fabric.

23. A takedown unit for a circular knitting machine that includes a knitting cylinder for forming tubular fabric such that the tubular fabric hangs downward along a fabric travel path from the knitting cylinder, the takedown unit comprising:

a plurality of rollers mounted to an at least generally annular first frame that is for being mounted to the circular knitting machine so that the plurality of rollers extend at least partially around the fabric travel path, wherein the rollers are mounted for respectively rotating about rotational axes of the rollers for drawing down the hanging tubular fabric;

a plurality of cams mounted to an at least generally annular second frame that is for being mounted to the circular knitting machine so that the plurality of cams extend at least partially around the fabric travel path, with the first and second frames being relatively rotatable with respect to one another so as to cause relative rotation between the cams and the rollers, with said relative rotation between the cams and the rollers being around the fabric travel path; and an actuator positioned for engaging the cams in response to said relative rotation between the rollers and the cams, so that the cams actuate the actuator a plurality of times for each 360 degrees of said relative rotation between the rollers and the cams, with each actuation including a reciprocating motion of at least a portion of the actuator, wherein the actuator is operative for translating the reciprocating motion into the rotating of at least one of the rollers about its rotational axis.

24. A takedown unit according to claim 23, wherein the reciprocating motion is upright.

25. A takedown unit according to claim 23, wherein the actuator includes a lever and an output shaft for rotating substantially only in one direction in response to reciprocation of the lever, the output shaft is connected to the at least one roller for causing the rotating of the at least one roller about its rotational axis, and the lever follows at least portions of the cams in a manner that causes the reciprocation of the lever in response to said relative rotation between the rollers and the cams.

26. A takedown unit according to claim 23, wherein the takedown unit includes a plurality of actuators respectively associated with the rollers, wherein for each actuator and a respective roller, the cams actuate the actuator a plurality of times for each 360 degrees of said relative rotation between the rollers and the cams, with each actuation including a reciprocating motion of at least a portion of the actuator, and the actuator is operative for translating the reciprocating motion into the rotating of the roller about its rotational axis, and wherein the cams and the actuators are operative so the actuators operate synchronously to rotate the rollers synchronously.

27. A takedown unit according to claim 23, further comprising a guide mechanism for being encircled by the hanging tubular fabric and interacting with the rollers to define a plurality of nips for having the tubular fabric extend therethrough so as to at least partially define the fabric travel path and spread the hanging tubular fabric for facilitating engagement of the rollers against the tubular fabric.

28. A takedown unit according to claim 27, wherein the guide mechanism is not rigidly connected to any structure of the takedown unit so that the guide mechanism floats within the interior of the tubular fabric.

29. A takedown unit according to claim 23, wherein the cams are adjustable between at least first and second configurations, with the reciprocating motion imparted to the actuator by the cams while the cams are in the first configuration defining a first maximum displacement, and the reciprocating motion imparted to the actuator by the cams while the cams are in the second configuration defining a second maximum displacement that is greater than the first maximum displacement, such that the actuator rotates the at least one to a greater degree while the cams are in the second configuration than while the cams are in the first configuration.

30. A takedown unit according to claim 29, further comprising an adjuster for moving the cams at least between the first and second configurations.

31. A method of drawing down a tubular fabric, comprising:

positioning a plurality of rollers at least partially around the tubular fabric;

positioning a guide mechanism within the interior of the tubular fabric so that the guide mechanism spreads the tubular fabric and interacts with the rollers to define a plurality of nips through which the tubular fabric extends; and operating the rollers so that the rollers respectively rotate about rotational axes of the rollers and interact with the guide mechanism so that the tubular fabric is drawn down and the guide mechanism floats within the interior of the tubular fabric.

32. A method according to claim 31, wherein during the operating, the interior surface of an annular section of the tubular fabric that encircles the guide mechanism is in contact with the guide mechanism for substantially 360 degrees around the guide mechanism, and the rollers contact a majority of the outer surface of the annular section of the tubular fabric.

* * * * *